US007946873B2

(12) United States Patent
Chen

(10) Patent No.: US 7,946,873 B2
(45) Date of Patent: May 24, 2011

(54) PLUG WITH A SPARK MELTDOWN-PROOF STRUCTURE

(76) Inventor: Cho-Ying Chen, Taichung County (TW)

( * ) Notice: Subject to any disclaimer, the term of this patent is extended or adjusted under 35 U.S.C. 154(b) by 0 days.

(21) Appl. No.: 12/257,855

(22) Filed: Oct. 24, 2008

(65) Prior Publication Data

US 2010/0273339 A1 Oct. 28, 2010

Related U.S. Application Data

(62) Division of application No. 12/000,340, filed on Dec. 12, 2007, now Pat. No. 7,588,451.

(51) Int. Cl.
*H01R 11/22* (2006.01)

(52) U.S. Cl. ..... 439/269.2; 439/346; 439/265

(58) Field of Classification Search ..... 439/269.2, 439/270, 265, 266, 346, 352
See application file for complete search history.

(56) References Cited

U.S. PATENT DOCUMENTS

| | | | | | |
|---|---|---|---|---|---|
| 1,119,864 | A * | 12/1914 | Ovington | 439/269.2 |
| 1,890,484 | A * | 12/1932 | Allenic | 439/269.2 |
| 2,775,744 | A * | 12/1956 | Henneman | 439/269.2 |
| 4,451,102 | A * | 5/1984 | Reh | 439/266 |
| 4,566,187 | A * | 1/1986 | Chen | 29/857 |
| 6,244,889 | B1 * | 6/2001 | James | 439/352 |

* cited by examiner

*Primary Examiner* — Hien Vu
(74) *Attorney, Agent, or Firm* — Wang Law Firm, Inc.; Li K. Wang

(57) ABSTRACT

A plug with a spark meltdown-proof structure for a spark damaged-proof effect is mainly comprised of two center hinged inserters that can be pressed for angle rotation, each inserter has a conductor, one end of which is connected with the output electric wire and the other end is connected or disconnected with the inserting conductor which can be inserted into the socket; through the said structure, when the plug is released from or inserted into the socket, current can be disconnected first at the instant to prevent conductors sparks-meltdown problems in the plug insertion process from happening.

3 Claims, 3 Drawing Sheets

PLUG WITH A SPARK MELTDOWN-PROOF STRUCTURE

CROSS-REFERENCE TO RELATED APPLICATION

The application is a Divisional application of Ser. No. 12/000,340, filed Dec. 12, 2007, now U.S. Pat. No. 7,588,451, and entitled "PLUG WITH A SPARK MELTDOWN-PROOF STRUCTURE".

BACKGROUND OF THE INVENTION (a) Field of the Invention

The invention is related to a plug with a spark meltdown-proof structure whose main arts and purposes are that: The inserting conductors of the plug are made to angle rotatable and provided with platinum contacts, wherein it is installed with inserting conductors being mutually contacted with inserters to connect with the power source, and when the plug is inserted into or released from the socket, current between inserter and inserting conductors is disconnected first to avoid the conductors sparks-meltdown effect due to friction.

(b) Description of the Prior Art

The conventional plug structure is mostly comprised of two fixed conductors which are inserting connected with the socket conductors to reach current connection effect. Whereas said conventional structure has the following imperfections: At the instant when the conductors are inserted into or released from the socket conductors, it is in current-connection status, hence sparks may occur due to instant friction contact, and the copper conductors may be meltdown by the high temperature sparks. In other words, the fact that the conventional plugs and sockets may cause sparks not only makes people feel unsafe, but also may damage the conductors.

SUMMARY OF THE INVENTION

As shown in FIGS. 1, 2, 3, the plug is internally installed with two angle rotatable inserters and inserting conductors for mutual electrical contact with inserters; wherein the two inserters having a hinge piece and having rods and spring for action control are hinged on center of axis and are internally made with conductors being connected with output electric wire on one end thereof and forming current connecting or disconnected statuses with inserting conductors on the other end thereof, while inserting conductors are used for inserting into the socket; further, conductors of inserters and inserting conductors are made with platinum contacts.

BRIEF DESCRIPTION OF THE INVENTION

DETAIL DESCRIPTION OF THE PREFERRED EMBODIMENTS

Figure 1:
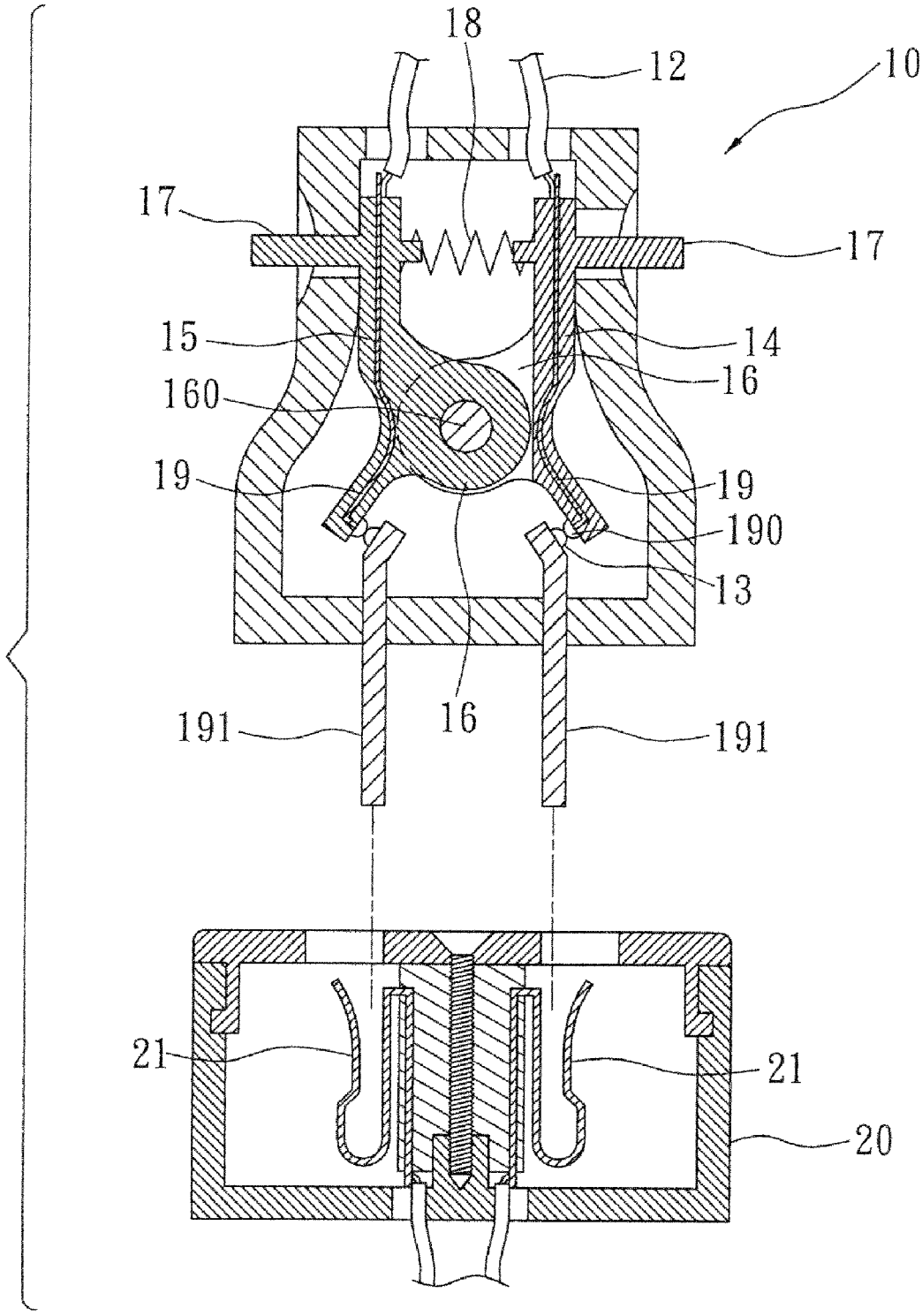
FIG. 1 is a structure sectional view of the present invention

The present invention discloses that a plug with a spark meltdown-proof structure is comprised of a plug 10 being internally installed with two angle rotatable inserters 14, 15 and inserting conductors 191 for mutual electrical contact with inserters 14, 15; wherein inserters 14, 15 having a hinge piece 16 and having rods 17 and spring 18 for action control are hinged on center of axis 160 and are internally made with conductors 19 being connected with the output electric wire 12 on one end thereof and forming electric connecting or disconnected statuses with inserting conductors 191 on the other end thereof; further, the mutual contacting surfaces between conductors 19 of inserters 14, 15 and inserting conductors 191 are made with platinum contacts 190, 13, while inserting conductors 191 are used for inserting into the socket 20.

Figure 2:
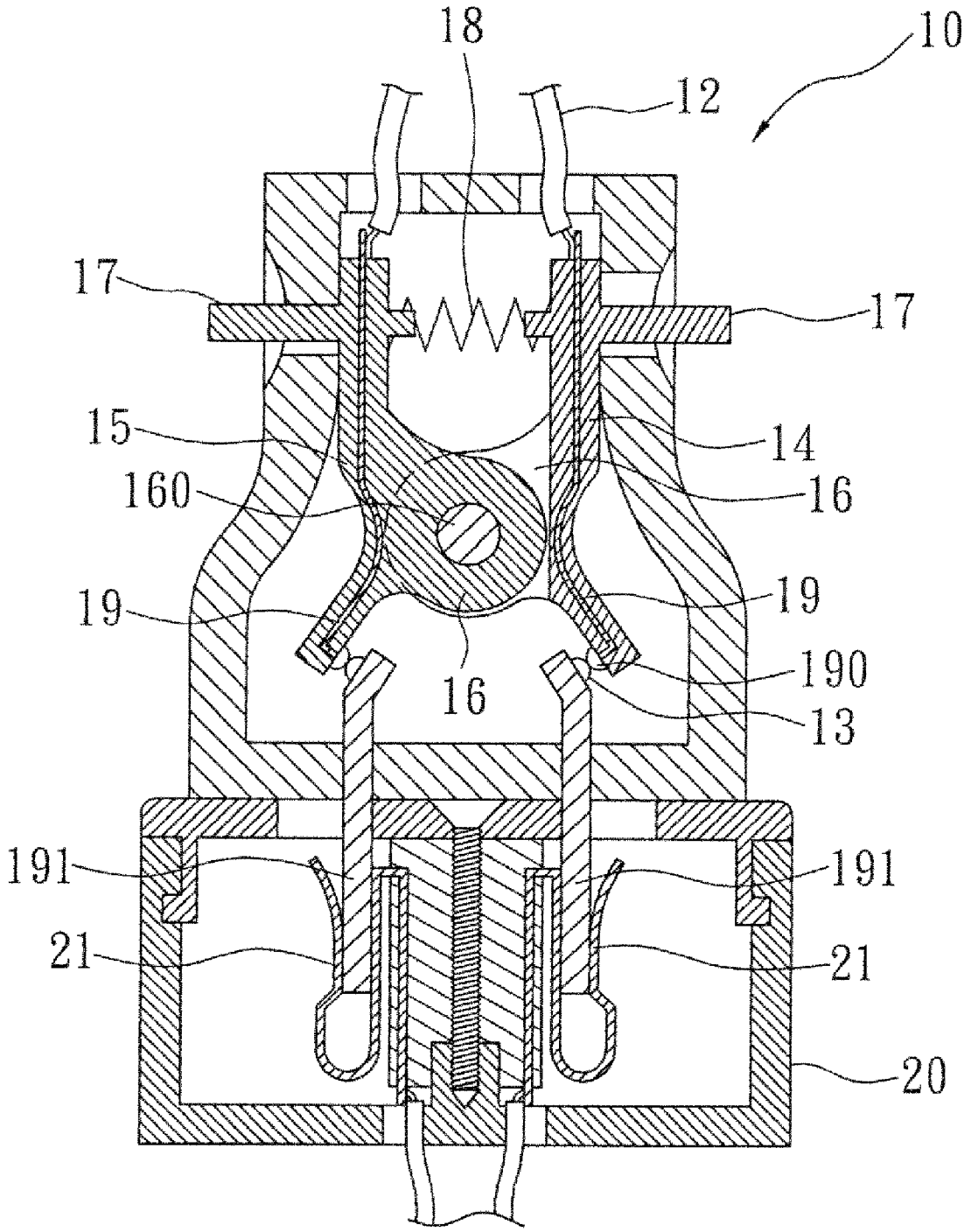
FIG. 2 is a schematic view of the present invention showing the plug-in socket status.
Figure 3:
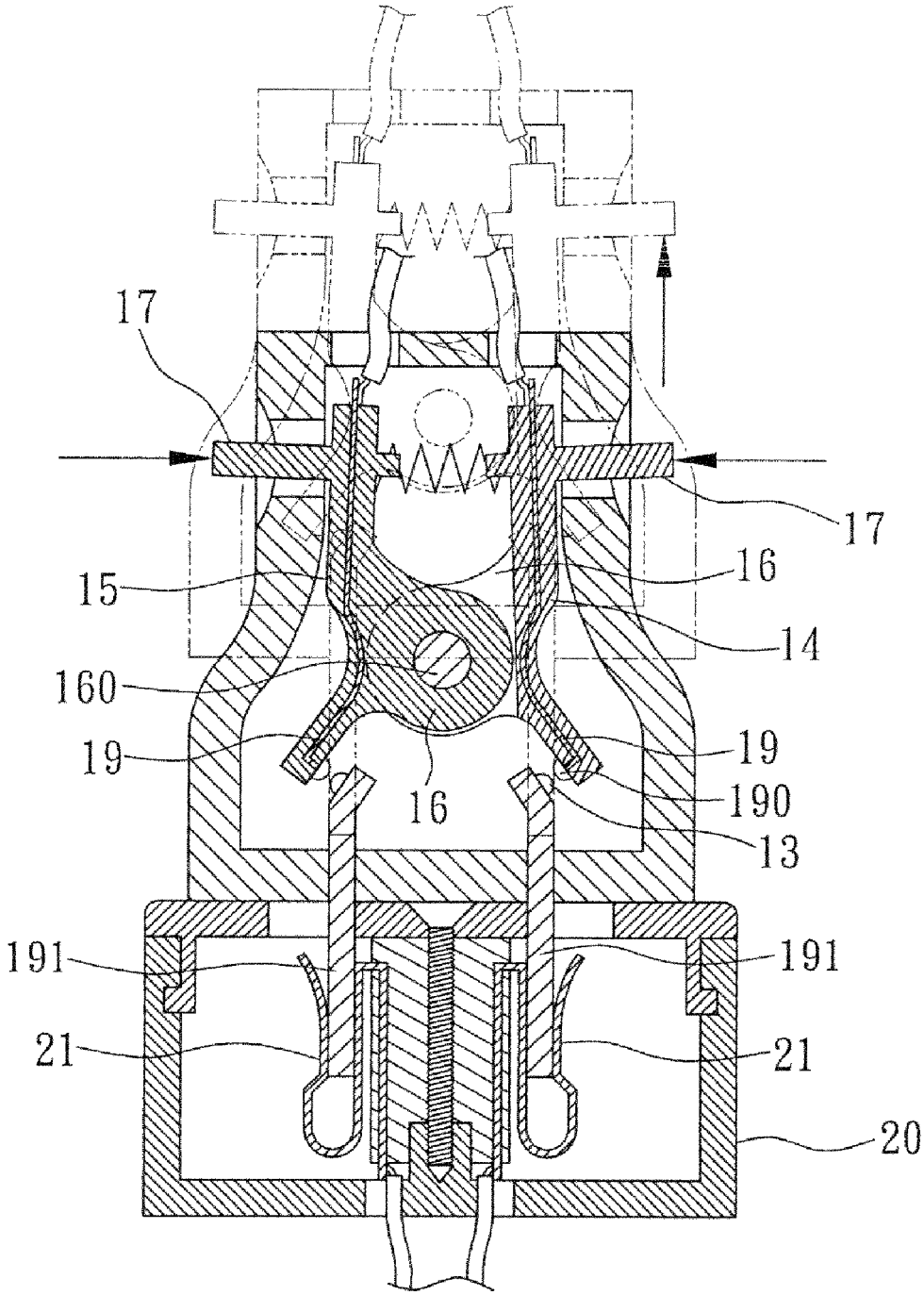
FIG. 3 is a schematic view of the present invention showing the unplugged socket status.

Utilization and effectiveness of the present invention is as shown in FIGS. 1, 2, 3, at the initial instant when plug 10 is inserted into socket 20, platinum contacts 190 on conductors 19 of inserters 14, 15 is released from platinum contact 13 of inserting conductors 191 to appear no current output, hence even though inserting conductors 191 are in contact with conductors 21 of socket 20, no spark is occurred until that when the insertion is completed as shown in FIG. 2, platinum contacts 190 on conductors 19 of inserters 14, 15 are in contact with platinum contacts 13 of inserting conductors 191 to transmit normal output current. When plug 10 is released from socket 20 as shown in FIG. 3, rods 17 of the two inserters 14, 15 are coincidently pressed by the fingers holding plug 10 allowing platinum contacts 190 on conductors 19 of inserters 14, 15 to be released from platinum contacts 13 of inserting conductors 191 thereby forming current disconnection to stop current output, hence the effectiveness of sparks-free during current disconnection can be achieved; further, as platinum contacts 13, 190 are point to point contacted in arc surfaces while inserting conductors 191 and conductors 21 of socket 20 are contacted in perpendicular flat planes, when plug 10 is inserted or released, it can be ensured that the effects of current connection or disconnection are all done at the platinum contacts 13, 190.

As described above, the spark-prevention effect, or i.e. the effect of reducing possible spark-meltdown damages on plug 10, conductors 21 of socket 20 can be obtained by the present invention. In addition, as platinum contacts 13, 190 of the present invention enhance the high temperature resisting effect, conductors 19 of inserters 14, 15 and inserting conductors 191 are uneasily meltdown by the high temperature causing by instant surge current at instant current connection, and further due to the switching characteristics of plug 10 for current connection/disconnection, when plug 10 is pulled out with or without the power source of electrical appliance in use being shut-off, the effectiveness of double-safety assurance is achieved.

As summarized from the above descriptions, the structure of the invention does have a better practical usefulness and enhanced functions.

I claim,

1. A plug with a spark meltdown-proof structure comprising:

a housing having two rotatable inserters mounted therein, the two rotatable inserters being opposite to each other, each rotatable inserter having a hinge piece, the rotatable inserters being hinged through two hinge pieces, each rotatable inserter having a rod protruding from the rotatable inserter away from the opposing rotatable inserter, each rotatable inserter having a first angle portion and an internal conductor for connecting to an electric wire;

a spring placed between two rotatable inserters; and two inserting conductors attached to the house, each inserting conductor having a second end portion, the second end portion of each inserting conductor being in contact with the first angle portion of one rotatable inserter;

wherein, when the rods on the two rotatable inserters move toward each other by pressing the rods inwardly, the inserting conductors disconnect from the two rotatable inserter, thus preventing sparks when the plug is removed from a power source.

2. The plug with a spark meltdown-proof structure as claimed in claim 1, wherein mutual contact surfaces between the rotatable inserters and the inserting conductors are made with platinum contacts for enhancing high temperature bearing effect.

3. The plug with a spark meltdown-proof structure of claim 1, wherein the spring being placed between two rods.

* * * * *